US005236071A

United States Patent [19]

Lee

[11] Patent Number: 5,236,071

[45] Date of Patent: Aug. 17, 1993

[54] APPARATUS FOR DETECTING COINS AND METHOD THEREOF

[75] Inventor: Jang-Hwan Lee, Suwon, Rep. of Korea

[73] Assignee: SamSung Electronics Co., Ltd., Suwon, Rep. of Korea

[21] Appl. No.: 559,343

[22] Filed: Jul. 30, 1990

[30] Foreign Application Priority Data

Oct. 23, 1989 [KR] Rep. of Korea ..... 89-15220

[51] Int. Cl.[5] ..... G07D 5/08

[52] U.S. Cl. ..... 194/200; 194/317

[58] Field of Search ..... 194/203, 317, 318, 319, 194/334, 200

[56] References Cited

U.S. PATENT DOCUMENTS 4,323,148 4/1982 Nichimoto et al. ..... 324/229 X
4,436,196 3/1984 Crisp et al. ..... 194/318
4,601,380 7/1986 Dean et al. ..... 194/318
4,705,154 11/1987 Masho et al. ..... 194/318 X

FOREIGN PATENT DOCUMENTS 3006893 9/1981 Fed. Rep. of Germany ..... 194/203
56-63685 5/1981 Japan .
2144252 2/1985 United Kingdom ..... 194/317

*Primary Examiner*—F. J. Bartuska
*Attorney, Agent, or Firm*—Robert E. Bushnell

[57] ABSTRACT

The present invention relates to an apparatus for detecting inserted coins and method thereof in units which are operated by inserting coins such as a vending machine, by using the configuration including the microcomputer for controlling the whole operation to detect the inserted coins, the quality, thickness and diameter detecting sensors for detecting the quality, the thickness and the diameter of the inserted coin and having the method comprising the steps of: counting the time required until the lastly positioned sensor senses the maximum value data after the firstly positioned sensor sensed the maximum value data; performing reset of the apparatus in case that the time required is more than the predetermined time; and discriminating the kinds of the inserted coins based on the quality, the thickness and the diameter maximum value data of the detected coins and the time required, thereby obtaining the advantage that the apparatus stops the operation and is reset when the insertion path is stopped up and that the kinds of the inseted coins are detected more correctly according to the quality, the thickness and the diameter of them.

17 Claims, 4 Drawing Sheets

APPARATUS FOR DETECTING COINS AND METHOD THEREOF

FIELD OF THE INVENTION

The present invention relates to an apparatus for detecting coins and method thereof, more particularly, to an apparatus for detecting inserted coins and method thereof in units which are operated by inserting a coin into the apparatus such as a vending machine, a subway-ticket vending machine, a token vending machine and a public telephone.

BACKGROUND OF THE INVENTION

As shown in a conventional vending machine, an apparatus operated by coins has detected the quality, the thickness and the diameter of the inserted coins to detect the kind of inserted coins, that is, to discriminate whether the inserted coin is a counterfeit one or a normal one. However, it has been inefficient to detect correctly the kind of coins because of various elements, that is, changes of circumference, environment such as humidity, temperature and approximation of metal object, influencing selection of the coin detection circuit.

Also, the conventional apparatus does not detect whether the coin is passed entirely through an insertion path but detects whether the coin is required or repaid by controlling a gate. Accordingly, although the coin is clogged and not able to pass through the coin insertion path due to insertion of a crushed coin or a counterfeit one, the apparatus is operated continuously. For this reason, when other users insert coins without knowing about the clogging of the insertion path, they suffer losses with reluctance.

On the other hand, methods for detecting coins are disclosed in U.S. Pat. No. 4,436,196 and Japanese laid-open Patent No. Sho 56-63685 respectively to discriminate the kind of coins, in which the automatic compensation of parameters is produced and the compensated signal is produced to discriminate the coins according to the material quality, the thickness, and the diameter of the coins and in which the kind of coin is discriminated by comparing the time required for each checking element.

The method disclosed in the U.S. Pat. No. 4,436,196 is one for detecting the coins in which a flux change occurs when the coin passes between the coil runway which has been associated with a coil set comprising a transmit coil and a receive coil and the coils of the coil set, and the signals derived from the received coil are combined to produce a compensated signal corrected for environmental changes, thereafter the compensated signals and the stored coil parameters and compared with each other.

In this method, firstly the first coil set selects coins to generate the information about the coin in the device using a coin or a token and then the second coil automatically sets parameters according to the environmental change and apparatus by providing a reference signal which compensates for temperature and drift. Detecting the sum of coins is performed by comparing the compensated signal with the stored coin parameter to detect the coin by the quality, the thickness and the diameter of the coins. Alternatively, the second method disclosed in Japanese laid-open Patent No. Sho 56-63685 is a method in which the first to the third checking elements are arranged according to the coin runway such that one end of the coin for discrimination is located on the third checking element while the other end thereof is located between the first checking element and the second one. The ratio between the time required for the back end of the coin to pass the third checking element after the back end of the coin has passed the first checking element and the time required until the back end of the coin has passed the second checking element after the back end of the coin has passed the first checking element is calculated.

Thereafter with the calculated value, the kind of coins are detected according to the compared result which has been obtained by comparing the above value with the memorized acceptable values. According to the aforementioned method, the kind of coin is detected according to the ratio of time required for the coin to pass the state of predetermined checking by using contactless type checking elements which are located in relation to a predetermined place so that it is not necessary to have high accuracy for installation of checking elements and checking elements are discriminated into three types regardless of the kind of coins.

The methods for detecting coins, in accordance with the U.S. and Japanese patent, detect only whether the inserted coin is a normal or counterfeit one by detecting the quality, the thickness and the diameter of the coin, and can not detect whether or not the insertion coin passes completely through the insertion path, and detect only whether the coin is inserted correctly or returned through the control of the gate. Accordingly, it is critical that the unit operates continuously even when the crushed or counterfeit coins are inserted but do not pass through the insertion path and cause the path to clog up.

SUMMARY OF THE INVENTION

The present invention is to solve the aforementioned problems and its object is to provide a method for detecting more exactly the kind of inserted coins by the time required to pass coins through the insertion path, detecting whether or not the insertion path is clogged, and resetting the apparatus in a non-operative state if the path is clogged, with respect to a method for detecting coins based on quality, thickness and diameter of the coins.

Another object of the present invention is to provide a coin detecting apparatus to achieve the aforementioned object.

To achieve the aforementioned object, a method for detecting the kind of coins by detecting the quality, thickness and diameter of the inserted coins, comprising the steps of: counting the time required until the last positioned sensor senses the maximum value of data after the first positioned sensor sensed the maximum value of data; performing reset of the apparatus when the time required is more than a predetermined time; and discriminating the kinds of the inserted coins based on the quality, thickness and diameter maximum data for the detected coins and the time required.

Also, the coin detecting apparatus of the present invention, comprises a microcomputer for controlling the whole operation to detect the inserted coins; a crystal oscillator for inputting a clock to the microcomputer; a quality detecting sensor for outputting an interrupt request signal according to insertion of the coins and simultaneously sensing a quality of the inserted coins; a thickness detecting sensor for sensing a thickness of the inserted coins; a diameter detecting sensor for sensing a diameter of the coins; an output circuit for respectively outputting sensed signals for the quality, thickness and diameter detecting sensors; a counter for outputting the quality, thickness and diameter data of the inserted coins according to the output signal from the output unit and thereby inputting the data to the microcomputer; a memory for storing the basic maximum value data and the passing time of the coins to be inserted and inputted to the microcomputer; a gate driver for receiving and repaying the inserted coins by driving the gate according to control of the microcomputer; a detecting circuit for receiving a coin receipt signal and inputting the signal to the microcomputer; and a repayment detecting circuit for detecting a coin repayment signal and inputting the signal to the microcomputer.

An apparatus for detecting coins has, as aforementioned, a configuration such that three detecting sensors located on the insertion path of the coins sense the quality, thickness and diameter of the inserted coins, sense the time required to detect the maximum value data from the inserted coins, that is, the time required to sense the maximum value data by the last detecting sensor after the first detecting sensor sensed the maximum value data, judge that the coin entry path was clogged if the time required is more than the predetermined time, and reset to stop the apparatus to prevent coins from being inserted by other users.

Alternatively, when the inserted coins pass through the insertion path, each detecting sensor discriminates the kind of coins based on the maximum value data of the quality, thickness and diameter of the inserted coins and the time required for sensing the coins, thereby to correctly detect the kind of coins.

BRIEF DESCRIPTION OF THE INVENTION

The above objects and other advantages of the present invention will become more apparent by describing the preferred embodiment of the present invention with reference to the accompanying drawings in which.

DETAILED DESCRIPTION OF THE INVENTION

Figure 1:
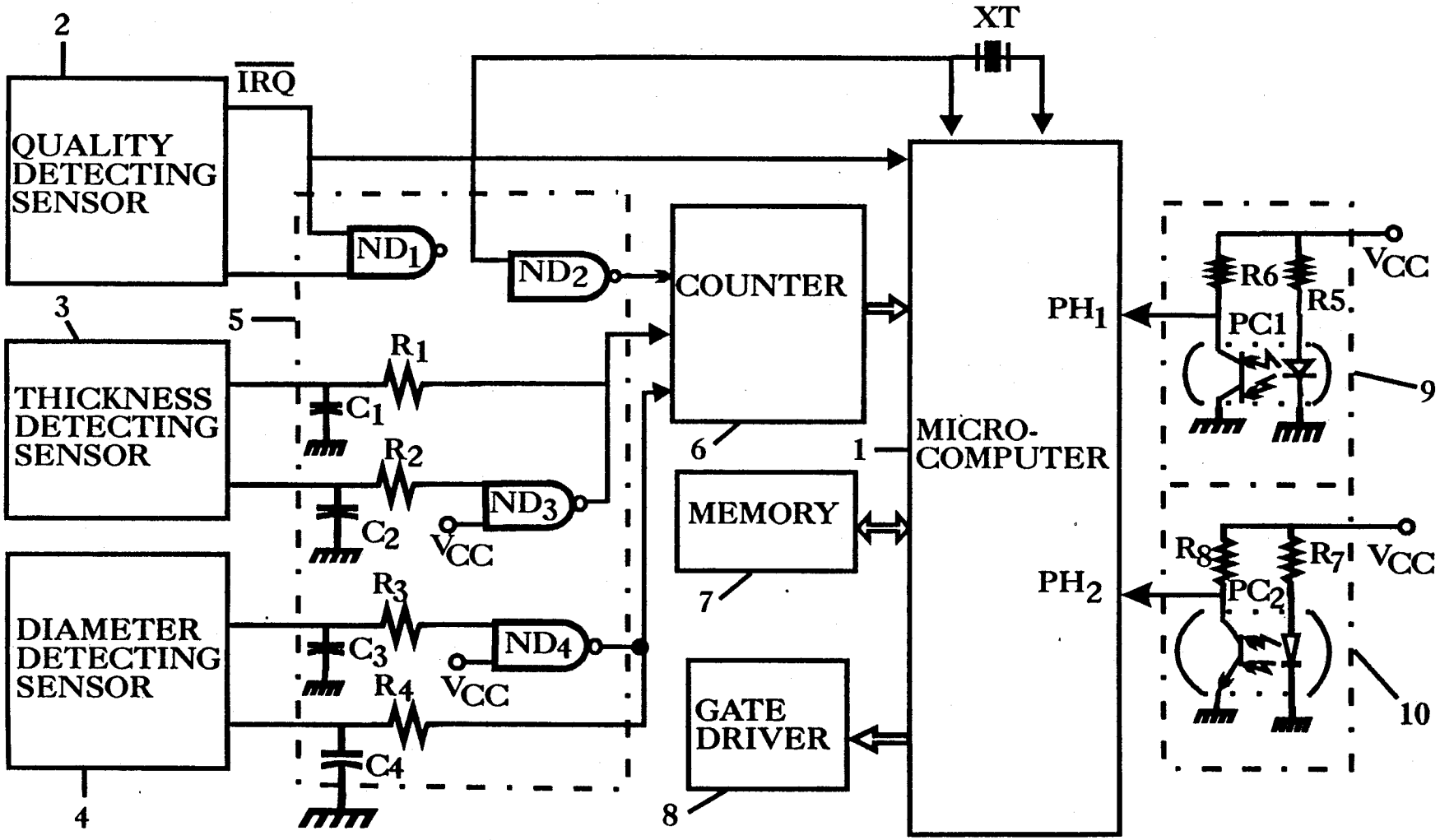
FIG. 1 is a circuit diagram of a coin detecting apparatus according to the present invention.

FIG. 1 shows a circuit diagram of a coin detecting apparatus which adopts a method of detecting coins according to the present invention. As shown in FIG. 1, the apparatus includes a microcomputer 1, a crystal oscillator XT for inputting the operation clock signal to the above microcomputer 1, a material quality detecting sensor 2 for outputting an interrupt request signal $\overline{IRQ}$ according to insertion of the coins and for simultaneously sensing the material quality of the inserted coins, thickness and diameter detecting sensors 3 and 4 for sensing the thickness and the diameter of the inserted coins, an output circuit 5 composed of NAND gate $ND_1$ to $ND_4$, condensers $C_1$ to $C_4$, resistors $R_1$ to $R_4$, the output circuit outputting the sensed signals from sensing sensors 2 to 4 respectively, a counter 6 for outputting the data of the quality, the thickness and the diameter of the inserted coins according to output signals of the output circuit 5 and inputting the data to the microcomputer 1, a memory 7 for storing basic maximum value data of each coin to be inserted and the time of passages and outputting them to the microcomputer 1, a gate driver 8 for driving the gate by controlling microcomputer 1 to receive or repay the inserted coins and reception and repayment detecting circuits 9 and 10, composed of resistors $R_5$ and $R_6$, $R_7$ and $R_8$ and photocouplers $PC_1$ and $PC_2$ for detecting receipt and repayment signals of coins and inputting the signals to the microcomputer 1.

According to the coin detecting apparatus as constructed above, crystal oscillator XT is oscillated to input operation clock signals to the microcomputer under the power voltage supplied at terminal Vcc.

Consequently, when the coin is inserted, the inserted coin passes along the quality detecting sensor 2, the thickness detecting sensor 3, and the diameter detecting sensor 4 in sequence. Therefore, the quality detecting sensor 2 outputs the interrupt request signal $\overline{IRQ}$ and resets the microcomputer 1 while the sensors 2 to 4 output the sensed signals of quality, thickness and diameter of the inserted coin and input them via the output circuit 5 to the counter 6. This counter 6 outputs the data about the quality, thickness, and diameter of the inserted coins and inputs them to the microcomputer 1.

Figure 2:
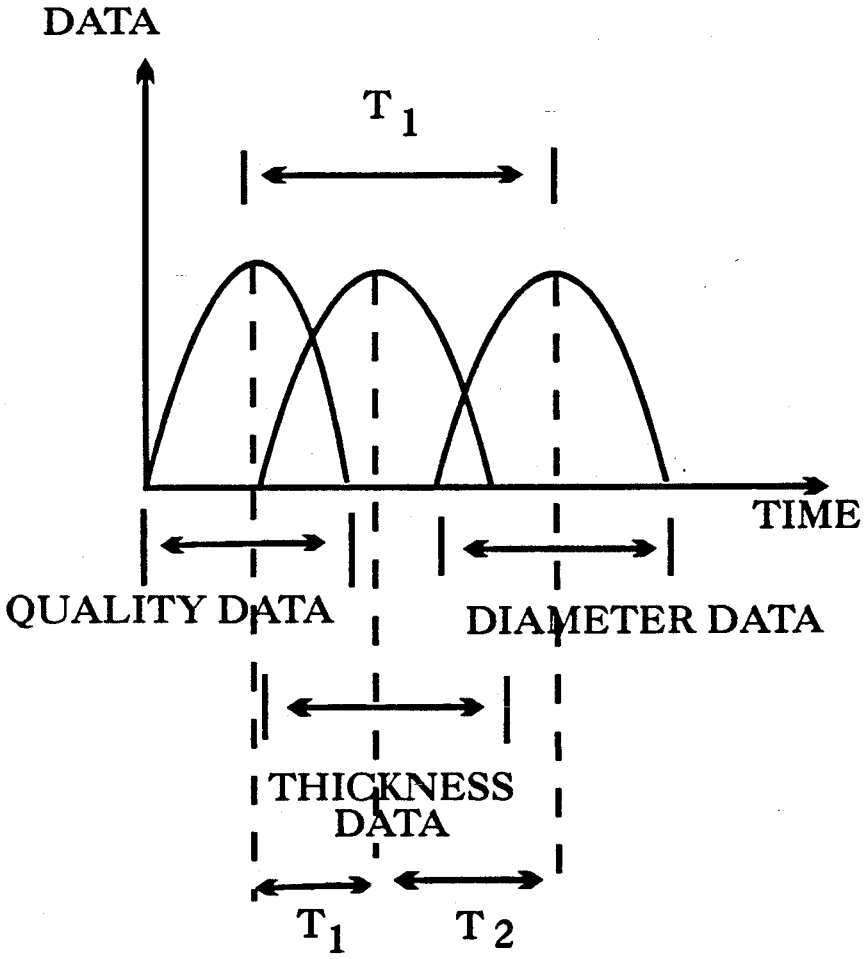
FIG. 2 is a graph showing output data of detecting sensors shown in FIG. 1.

At this time, the data of quality, the thickness and diameter from counter 6 change as shown in FIG. 2. In this case, the microcomputer 1 detects the maximum value of the data among the data for quality, thickness and diameter, and then the microcomputer 1 detects the time required $T_1$ until the maximum data of diameter is detected after the maximum data for quality is sensed.

When the time required $T_1$ is more than a predetermined period $T_2$, the microcomputer determines that the insertion path of the coin is stopped up and resets the apparatus, while when the time required $T_1$ is less than a predetermined period $T_2$, it compares the maximum data of the detected quality, thickness and diameter and the time required $T_1$ with the basic data which has been stored in the memory, detects whether the inserted coin is normal or counterfeit and thereafter receives or repays the coins by controlling the gate driver 8 according to the result, determines whether the coin is received or repaid according to the output signals from the receipt and repayment detecting circuits 9 and 10 and if not, resets the apparatus.

Figure 3A:
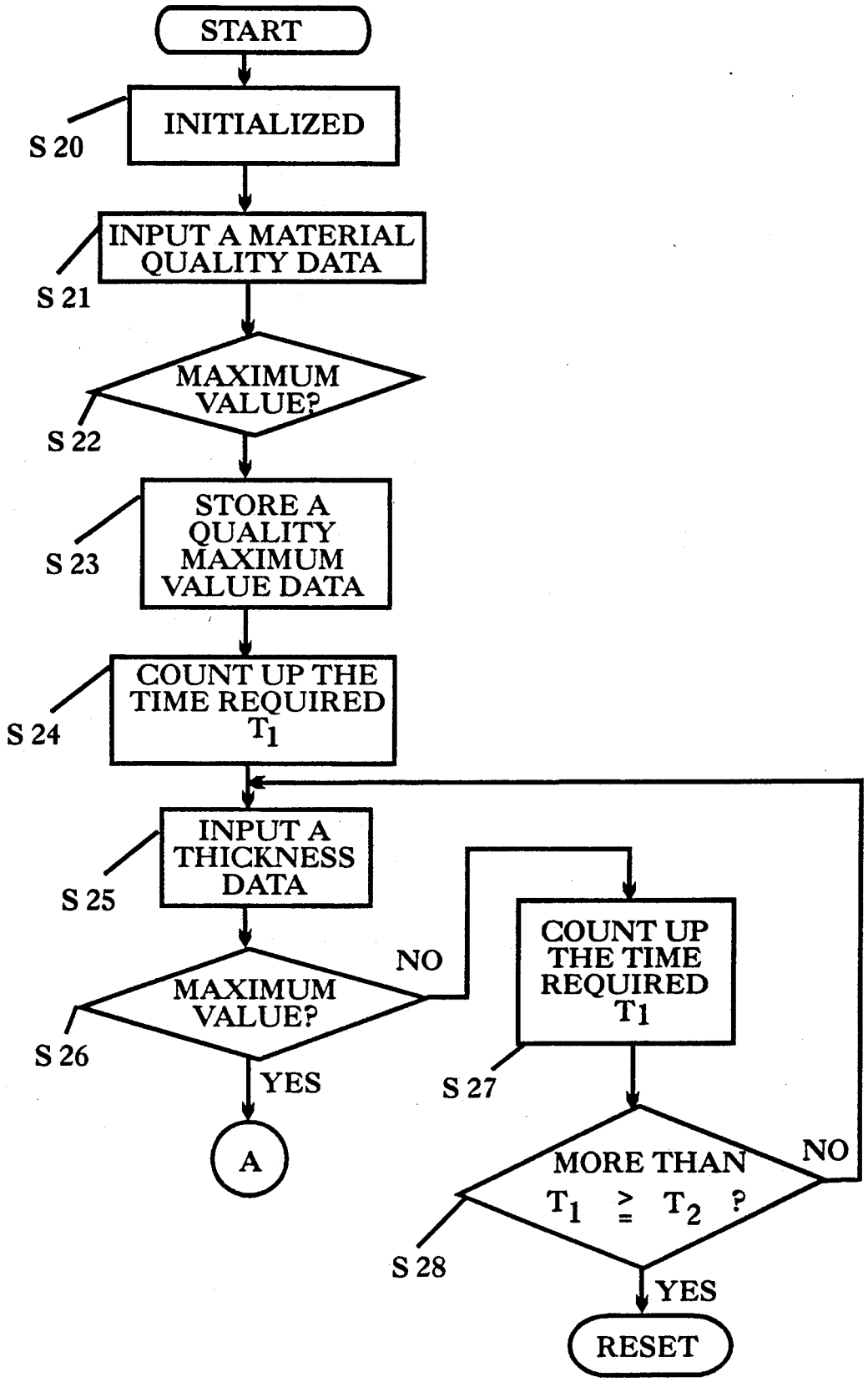
FIGS. 3(*a*) and 3(*b*) are flowcharts showing a method for detecting coins according to the present invention.
Figure 3B:
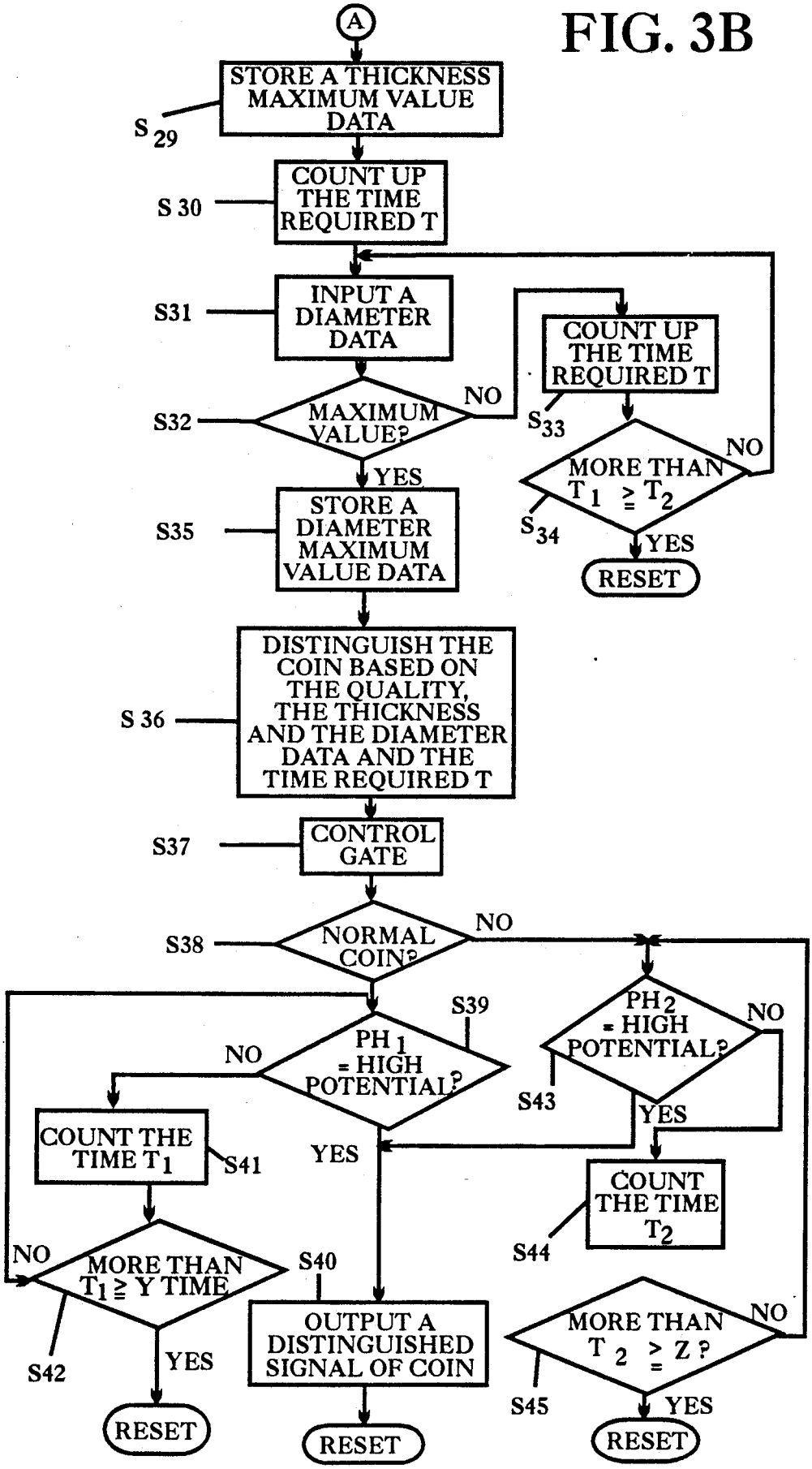

Alternatively, FIGS. 3(*a*) and 3(*b*) show flowcharts explaining the method of control with a reference symbol S showing the steps in the drawing. In the present invention, when the set starts to detect the coin, the initialization is performed at step 20, the data for the quality from counter 6 is applied at step 21 after the coin is inserted. At step 22, it is determined whether the data for quality of the coin is a maximum value or not and if so, the maximum value data is stored into the microcomputer 1 at step 23, and thereafter control proceeds to step 24 and the microcomputer 1 starts to count the time required $T_1$. At step 25, microcomputer 1 receives the data of the thickness outputted from counter 6 and proceeds to step 26, where it determines whether the data of the thickness of the coin is a maximum value or not, and if not (in the case of No), the time required $T_1$ is counted up in step 27. At Step 28, it is determined whether the time $T_1$ is more than or equal to the predetermined period $T_2$ or not, if not (in the case of No), the procedure returns to the step 25, and performs the step after step 25 repeatedly. If the maximum data of the thickness has not been input until more time lapses than the predetermined period $T_2$ (in the case of Yes), the microcomputer resets the apparatus to stop the operation thereof. If the maximum data of the thickness is input before the predetermined period $T_2$ at step 26 (in the case of Yes), control proceeds to step 29, then the maximum value data is stored into the microcomputer 1 at step 29 of FIG. 3*b* and control proceeds to step 30, and, the time required $T_1$ is counted up continuously. After that, the data of diameter from counter 6 input at step 31 and then at step 32, and it is determined whether the data of diameter is a maximum value or not. If not, (in the case No), the time required $T_1$ is counted up at step 33 and then at step 34, it is determined whether the time required $T_1$ is more than the given period $T_2$ or not. If not (in the case of No), the procedure returns to step 31 and performs the steps after step 31 repeatedly. If the maximum value data of the diameter is not input until a predetermined time $T_2$ elapses, the microcomputer resets the apparatus to stop the operation.

On the contrary, if the maximum data of the diameter is input before the predetermined period $T_2$ (in the case of Yes), at step 32, the procedure proceeds to step 35 and the maximum data is stored at step 35. At step 36, the maximum data of the quality, thickness and diameter, and the time required $T_1$ are compared with those predetermined data stored in the memory by using the microcomputer 1 to distinguish between the kind of inserted coins. Still further, at step 37, the gate of gate driver 8 is controlled according to the distinguished kind of coins to receive or repay the coin, and then the procedure goes to step 38, where it determines whether the coin is normal or not. If so (in the case of Yes), the detecting circuit 9 detects the receipt of a coin and detects whether the high potential has been input to the input terminal PH1 of the microcomputer 1, wherein at step 40 the detecting signals (i.e., the amount signals) are output. Alternatively, if the high potential has not been input (in the case of No), the procedure proceeds to step 41, where it determines whether the time required $t_1$ for passing to photocoupler $PC_1$ via the gate is more than the predetermined period Y stored in the microcomputer 1. If so (in the case of Yes), the apparatus is reset and if not (in the case of No), the procedure returns to step 39 and performs the procedure after step 39 repeatedly.

Meanwhile, at step 38 if the inserted coin is abnormal (in the case of No), the procedure proceeds to step 43 and then repayment detecting circuit 10 detects the repayment of the coin to distinguish whether high potential is input to the input terminal PH2 of the microcomputer or not.

At this time, when the coin is repaid normally and high potential is input to the input terminal PH2 of the microcomputer 1 (that is, in the case of Yes), the distinguished signal of the coin is output at step 40. Alternatively, at step 43, when high potential has not been input to the input terminal PH2 of the microcomputer 1, the time required to pass via the gate to photocoupler PC2 is counted up at step 44.

After that, the procedure proceeds to step 45, where it determines whether the time required $t_2$ is more than the reference time Z stored in the microcomputer 1 or not.

As a distinguished result when the time required is not more than the reference time (in the case of No), the procedure returns to step 43 and performs the steps after step 43, whereas at step 45, when the time required $t_2$ is more than a predetermined time Z, the apparatus is reset.

As described above in detail, the present invention has advantages that when the coin insertion path is stopped up the microcomputer resets the apparatus to stop the operation, thereby users can know about the clogged state of the apparatus and it has the effect of detecting more exactly the kind of coins by the quality, thickness and diameter of the coin, and the time for passing the insertion.

What is claimed is:

1. A method for determining coin identity by detecting quality, thickness and diameter of coins inserted into a coin receiving device having a series of sensors for sequentially sensing the quality, thickness and diameter of a coin as the coin travels along a predetermined path, comprising the steps of:

counting the time required until a last positioned sensor of a serial array of a plurality of sensors senses the coin after a first one of the plurality of sensors senses the coin;

restarting the counting of the time required when the counter time exceeds a predetermined time; and determining the identity of the inserted coins based on the value data of the quality, the thickness and the diameter of the detected coins, and on the counted time.

2. The method of claim 1, further comprising the steps of:

providing a coin insertion signal upon insertion of a coin;

providing a coin passage signal upon successful passage of coin past all of said sensors;

providing a coin jamming signal when said coin insertion signal is not followed by a coin passage signal.

3. The method of claim 1, further comprising the steps of:

determining the maximum value from said first positioned sensor and a first check time when said maximum value was sensed by said first positioned sensor;

continuously determining a later check time when sequent positioned sensors sense value data until such event that the maximum value from the last positioned sensor is sensed; and comparing said first check time with said later check time to determine if jamming of the coin has occurred.

4. An apparatus for evaluating coins, comprising:

a plurality of conducting means for conducting sensed signals representing quality and a plurality of dimensions from a serial array of a plurality of sensors disposed along a path of travel for coins to sense quality and a plurality of dimensions of the coins passing along said path of travel;

means for providing an interrupt signal indicative of passage of each of the coins passing a first of the plurality of sensing means;

counting means coupled to receive said sensed signals from said conducting means, for generating quality data and a plurality of dimension data from said sensed signals;

control means for:

selecting a first maximum value from among said quality data and said plurality of dimension data, selecting a second maximum value for one of said plurality of dimensions from among said plurality of dimension data, determining a first period of time until occurrence of said sensed signals representing one of said plurality of dimensions corresponding to said second maximum value, if said first period of time is greater than a predetermined period of time, making a determination of whether to accept or to reject each of the coins by comparing said first maximum value and said first period of time with predetermined data, and generating output signals for operating a gate to enable one of either reception or rejection of each coin, in dependence upon said determination.

5. The apparatus of claim 4, wherein said control means is further comprised of:

determining whether each coin is received or rejected in accordance with said output signals; and if each coin is not received or rejected in accordance with said output signals, determining identity of each of the coins in dependence upon said interrupt signal, said quality data and said plurality of dimension data.

6. The apparatus of claim 4, further comprising:

a gate controlled by the microcomputer for directing the coins in a repayment mode and in a receiving mode; and means for detecting passage of said coins from said gate in said receiving mode and for providing a coin receipt signal to the microcomputer.

7. The apparatus of claim 4, further comprising:

a gate controlled by the microcomputer for directing the coins for repayment; and means for detecting passage of said coins for repayment from said gate and for providing a coin repayment signal to the microcomputer.

8. The apparatus of claim 4, further comprising:

a gate disposed to control passage of coins;

means for detecting passage of coins from said gate in a receiving mode, and for providing a coin receipt signal to the microcomputer.

9. The apparatus of claim 4, further comprising:

a gate disposed to control passage of coins;

means for detecting passage of coins from said gate in a repayment mode and for providing a coin repayment signal to the microcomputer.

10. The apparatus of claim 5, further comprising:

a gate disposed to control passage of coins;

means for detecting passage of coins from said gate in a receiving mode, and for providing a coin receipt signal to the microcomputer.

11. The apparatus of claim 10, further comprising:

means for providing a signal indicating passage of said coin past said array of sensors;

means for receiving said interrupt signal;

means for detecting jamming of coins along said path of travel when the elapsed time for said coin to pass between said array of sensors is greater than a predetermined time period.

12. In an apparatus for evaluating coins having a coin travel path, a series array of sensors disposed along said coin travel path for sensing the quality, thickness and diameter of a coin as the coin travels along the coin travel path, the improvement comprising:

a microcomputer for determining a first maximum value detected by a first sensor and a last maximum value detected by a last sensor in said series array of sensors, and for comparing the difference in times when the first and last maximum values were detected with a predetermined time period in order to determine if said coin is jammed;

means for providing an interrupt signal corresponding to the passage of said coin past said series array of sensors;

a counter for receiving signals from said series array of sensors and for determining the elapsed time for said coin to pass between said series array of sensors; and a memory for storing data corresponding to acceptable signals and elapsed time combinations, and for providing said data to the microcomputer.

13. The apparatus of claim 12, further comprising:

a gate having a receiving mode controlled by the microcomputer, for directing the coins for repayment; and means for detecting passage of said coins from said gate in said receiving mode, and for providing a coin receipt signal to the microcomputer.

14. The apparatus of claim 12, further comprising:

a gate controlled by the microcomputer, for directing the coins for repayment; and means for detecting passage of said coins for repayment from said gate, and for providing a coin repayment signal to the microcomputer.

15. The apparatus of claim 12, further comprising:

a gate having a receiving mode and disposed to control passage of coins; and means for detecting passage of the coins from said gate in said receiving mode, and for providing a coin receipt signal to the microcomputer.

16. The apparatus of claim 12, further comprising:

a gate disposed to control passage of coins;

means for detecting passage of coins from said gate in said repayment mode and for providing a coin repayment signal to the microcomputer.

17. The apparatus of claim 12, further comprising:

means for providing a signal indicating passage of said coin past said array of sensors;

means coupled to receive said interrupt signal and said passage indicating signal, for detecting jamming of coins along the coin travel path when said interrupt signal is not proceeded by a passage indicating signal.

* * * * *

UNITED STATES PATENT AND TRADEMARK OFFICE

CERTIFICATE OF CORRECTION

PATENT NO. : 5,236,071
DATED : 17 August 1993
INVENTOR(S) : Jang-Hwan Lee

It is certified that error appears in the above-identified patent and that said Letters Patent is hereby corrected as shown below:

Column 3,

Line 20, change "sense" to --detect--;

Line 21, change "detect" to --sense--;

Signed and Sealed this

Twenty-seventh Day of September, 1994

*Attest:*

Bruce Lehman

BRUCE LEHMAN

*Attesting Officer*

*Commissioner of Patents and Trademarks*